US005692354A

United States Patent [19]

Searer

[11] Patent Number: 5,692,354

[45] Date of Patent: Dec. 2, 1997

[54] COMBINED MOLDING AND MOLDING CAPS

[75] Inventor: Floyd A. Searer, Elkhart, Ind.

[73] Assignee: FAS Industries, Inc., Elkhart, Ind.

[21] Appl. No.: 675,575

[22] Filed: Jul. 3, 1996

[51] Int. Cl.[6] ..... E04F 19/02

[52] U.S. Cl. ..... 52/718.01; 52/716.1; 52/716.4; 52/717.04; D25/136

[58] Field of Search ..... 52/718.01, 718.02, 52/716.4, 716.5, 716.1, 717.03, 717.04, 717.05; D25/136, 137

[56] References Cited

U.S. PATENT DOCUMENTS

| | | | |
|---|---|---|---|
| D. 51,508 | 11/1917 | Plym . | |
| D. 131,025 | 4/1942 | O'Brien . | |
| D. 210,821 | 4/1968 | Stone . | |
| D. 211,629 | 7/1968 | Massagli . | |
| D. 269,210 | 5/1983 | Johansson . | |
| D. 283,357 | 4/1986 | Bancroft . | |
| D. 312,599 | 12/1990 | Johnston . | |
| 850,866 | 4/1907 | De Clements . | |
| 2,531,967 | 11/1950 | Bishop | 52/716.5 X |
| 3,408,250 | 10/1968 | Finefrock | 52/717.05 X |
| 3,422,584 | 1/1969 | Howard | D25/136 X |
| 4,083,592 | 4/1978 | Rubin et al. | 52/717.05 |
| 5,157,886 | 10/1992 | Azzar et al. | 52/717.05 |

FOREIGN PATENT DOCUMENTS

| | | | |
|---|---|---|---|
| 1185174 | 7/1959 | France | 52/717.04 |

*Primary Examiner*—Christopher Kent
*Attorney, Agent, or Firm*—Watson Cole Stevens Davis, PLLC

[57] ABSTRACT

A combined molding cap and molding strip wherein a molding strip having opposed attachment surfaces extends along the longitudinal axis thereof; a plurality of beaded ridges extends along one attachment surface of the molding strip and a plurality of fluted channels extends along the opposed attachment surface of the molding strip; and at least one molding cap having a surface including at least one of complementary fluted channels and beaded ridges for respectively engaging the beaded ridges and fluted channels of the molding strip so that the at least one molding cap is in closely abutting relationship with the molding strip at a desired location along the longitudinal axis.

In a modified embodiment the molding strip has a flat mounting surface and an opposed curved surface including at least one of fluted channels and beaded ridges, the mounting surface and the opposed curved surface extending along a longitudinal axis of the molding strip; at least one molding cap having a curved surface complementary to the opposed curved surface with at least one of complementary fluted channels and beaded ridges for engaging the beaded ridges or fluted channels of the molding strip so that the at least one molding cap is in closely abutting relationship with the molding strip at a desired location along the longitudinal axis.

11 Claims, 5 Drawing Sheets

COMBINED MOLDING AND MOLDING CAPS

BACKGROUND OF THE INVENTION

1. Field of the Invention

This invention relates to fixtures for finishing interior and exterior surfaces and, in particular, to such surfaces where it is desired to use a combination of a molding strip and molding cap(s) to provide a "finished" surface or appearance to building structures and especially in the interior of buildings, houses, recreational vehicles, etc., wherever molding strips themselves are normally employed in such structures.

2. Related Art

The following U.S. Patents are believed to be representative of the general state of the art with respect to the combined molding and molding cap structure forming the subject invention:

(1) U.S. Pat. No. 850,866 (Clements), entitled "CURBING", discloses a curbing ledge with longitudinally extending grooves for receiving cement to secure the curbing to the sidewalk;

(2) U.S. Pat. Des. No. 51,508 (Plym) illustrates a threshold plate having a raised, fluted exterior surface;

(3) U.S. Pat. Des. No. 131,025 (O'Brien) is a design for a conduit with a fluted curved exterior surface;

(4) U.S. Pat. Des. No. 210,821 (Stone) discloses a "Decorative Molding Strip" with a "scalloped" surface and including a molding cap attached to one end thereof;

(5) U.S. Pat. Des. No. 211,629 (Massagli) illustrates a "Construction Panel" with one side beaded and the opposing side having paired fluted portions;

(6) U.S. Pat. Des. No. 269,910 (Johansson) shows a combination articulation rail and connecting bar for screen walls showing a curved, fluted surface covering a chambered channel member;

(7) U.S. Pat. Des. No. 283,357 (Bancroft) is directed to a "Vent Sill Rail Extrusion" having fluted surface areas; and (8) U.S. Pat. Des. No. 312,599 (Johnston) illustrates a "Tailgate Reinforcement" with fluted side surfaces.

There is a need in the building trades industry for the combination of a prefabricated molding strip and molding cap and wherein the versatility of the combined molding strip and molding cap are increased by providing the two opposing sides of the molding strip with surfaces of different configuration, such as fluted channels and beaded ridges, respectively, and wherein each of two molding caps has a structured surface respectively "matching" a respective one of the differently configured surfaces of the molding strip that is exposed to view so that one of the prefabricated molding caps can be easily attached to the molding strip at any preferred location along the longitudinal axis thereof.

SUMMARY OF THE INVENTION

A primary object of the invention is to provide a prefabricated double-sided molding strip and molding caps attachable thereto with a minimum of effort on the part of the craftsman at the worksite.

A primary feature of the invention is to provide a more versatile prefabricated molding strip having differently configured opposing side surfaces and a molding cap assembly comprising two types of molding caps each of which has a respective attachment surface matching a respective one of the differently configured surfaces of the molding strip, whereby one type of the molding caps is readily attachable and affixed to the molding strip at any desired location along the longitudinal axis thereof.

An advantage of the combined molding strip and molding cap of the invention is the increased versatility afforded the on site construction craftsperson in selecting the prefabricated design of the surface of the molding strip that is exposed to view, while also enabling a prefabricated matching molding cap to be affixed to the selected exposed surface of the molding strip.

Another object of the invention is to provide an easier and more accurate way of aligning the molding and molding cap with respect to one another on site.

Another feature of the invention is that the combined molding strip and molding cap are automatically aligned with respect to one another because the molding cap has prefabricated attachment surface features matched to the exposed surface features of the molding strip such that the molding strip and the molding cap are automatically aligned with respect to one another upon engagement of the molding cap with the molding strip.

Another advantage of the invention is that the molding strip and the molding cap are readily mated in aligned relation to one another without the use of any additional aligning tools such as a carpenter's level or square.

A further object of the invention is that the molding cap of the invention is readily fastened at different locations along the longitudinal axis of the molding strip, thereby affording easy adjustment of the location of the molding cap with respect to the longitudinal axis of the molding strip.

A further feature of the invention is that the same matched attachment surface features of the molding cap with the surface features of the exposed surface of the molding strip also enable the molding cap to be re-located by sliding along the exposed surface of the molding strip.

A further advantage of the invention is that the position of the molding cap with respect to the longitudinal axis of the molding strip is easily and readily altered without the need to realign the molding cap and the molding strip with respect to one another.

Yet another object of the invention is to provide a prefabricated molding strip that affords a different surface appearance on each of the two possible longitudinally extending exposed surfaces, thereby enabling an on work site selection of either of the two surfaces to be exposed to view.

Yet another feature of the invention is that each of the two opposed side surfaces of the molding strip is produced with a different surface shape, such as fluted channels extending along the longitudinal axis on one side of the molding strip, and beaded ridges extending along the longitudinal axis on the other side of the molding strip.

Yet another advantage of the invention is that the molding strip of the invention enables a different appearance to be presented to the viewer merely by reversing the molding strip by 180 degrees and attaching the other side to the wall, door jam or base board, i.e. wherever molding strips are commonly employed in the building construction trade.

Yet a further object of the invention is to provide a combined molding strip and molding cap that is made in essentially flat or curved cross section.

Yet a further feature of the invention is that the combined molding strip and molding cap of the invention are produced in either flat or curved cross section, and wherein the curved cross section is selectable in either 45 or 90 degree radii Yet a further advantage of the invention is that the observable shape of the combined molding strip and molding cap of the invention are easily selectable to be flat or curved, thereby providing a combined molding strip and molding cap that vary in appearance.

BRIEF DESCRIPTION OF THE DRAWINGS

The above objects, features and advantages of the invention are readily apparent from the following description of preferred embodiments of the best mode of carrying out the invention when taken in conjunction with the following drawings, wherein.

DETAILED DESCRIPTION

Figure 1:
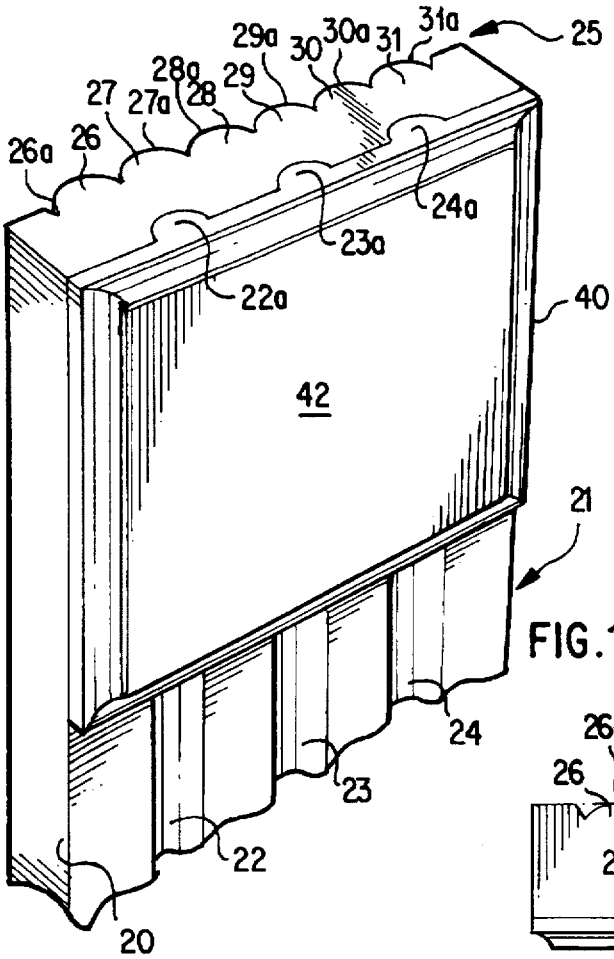
FIGS. 1–3 are respective front perspective, top and side views of a combined molding strip and molding cap in accordance with the invention, and wherein the molding strip includes fluted front and beaded back surfaces with the fluted surfaces of the molding strip being observable, and with the attachment surface of the molding cap matching the fluted surfaces of the molding strip.
Figure 2:
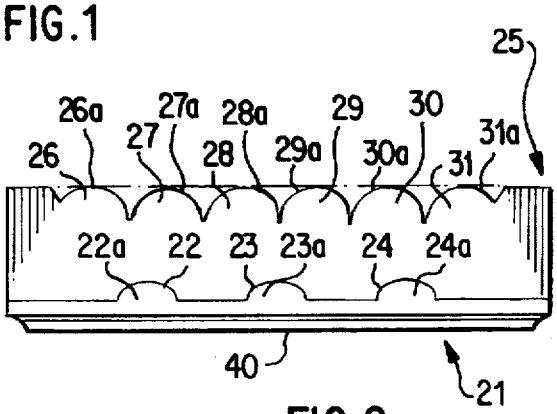
Figure 3:
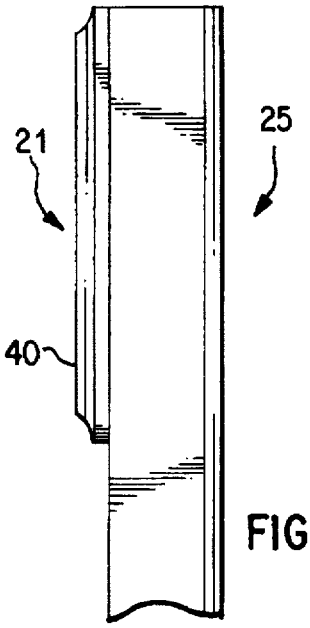

With respect to FIGS. 1–3, a first embodiment of the invention comprises a two-sided molding strip 20 with one fluted surface 21 having longitudinally-extending fluted channels 22, 23, 24 and the opposing surface 25 having longitudinally extending beaded columns 26, 27, 28, 29, 30 and 31. A cove-edged molding cap 40 is shown mated to the fluted surface 21 of the molding strip 20 by the engagement of longitudinally extending beaded ridges **22*a*, 23*a*, 24*a* of the molding cap 40 respectively within longitudinally extending fluted channels 22, 23, 24 of the molding strip 20. Longitudinally-extending ridges 22*a*, 23*a*, 24*a* have a slightly smaller radius than the radius of fluted channels 22, 23, 24 so that molding cap 40 is capable of sliding along the length of molding strip 20 to be fastened at any position along the length thereof. A plurality of molding caps similar to molding cap 40 may be attached at various and sundry locations along the length of molding strip 20**, for example at the top, bottom and midlength thereof.

Molding strip 20 is fastened to any ceiling, wall or floor surface (not shown) by any of the fastening techniques known to the building or construction trades, such as nails, staples, adhesives, etc. with surface 25 being attached to the ceiling, wall or floor surface so that rounded portions **26*a*, 27*a*, 28*a*, 29*a*, 30*a* and 31*a* of beaded ridges 26, 27, 28, 29, 30 and 31** are in abutting engagement with the structural surface of the building.

In FIG. 1 molding cap 40 is shown with a plane face 42; however as is described hereinafter, the molding cap 40 may also include a Rosette-type design, i.e. a design having three-dimensional characteristics. It is readily apparent that the sliding engagement of the molding cap(s) 40 with a molding strip 20 as described above affords a simple and accurate way of automatically aligning and positioning the molding cap(s) and molding strip with one respect to one another without additional alignment steps such as are required with conventional molding cap(s) and molding strips.

The following description is taken with respect to FIGS. 4–7 wherein the same embodiment as FIGS. 1–3 is illustrated with the exception that the molding strip 20 has been reversed, i.e. with the beaded ridges 26, 27, 28, 29, 30 and 31 in the exposed or viewable position, and with another type molding cap **40*a* attached to viewable surface 25, which was the side of the molding strip 20 that was to be attached to the structural surface of the building in the previously described embodiment of FIGS. 1–3. However, in this embodiment molding cap 40*a* is of another type having structural features on mating surface 41 that match the beaded ridges 26, 27, 28, 29, 30 and 31 of surface 25 of molding strip 20. In this embodiment, the matching surface features are fluted channels 32, 33, 34, 35, 36 and 37 on molding cap 40*a*. All the above-described features and advantages of the combined molding strips and molding caps with respect to FIGS. 1–3 are applicable to the molding strips and molding caps of FIG. 4–7**.

Figure 4:
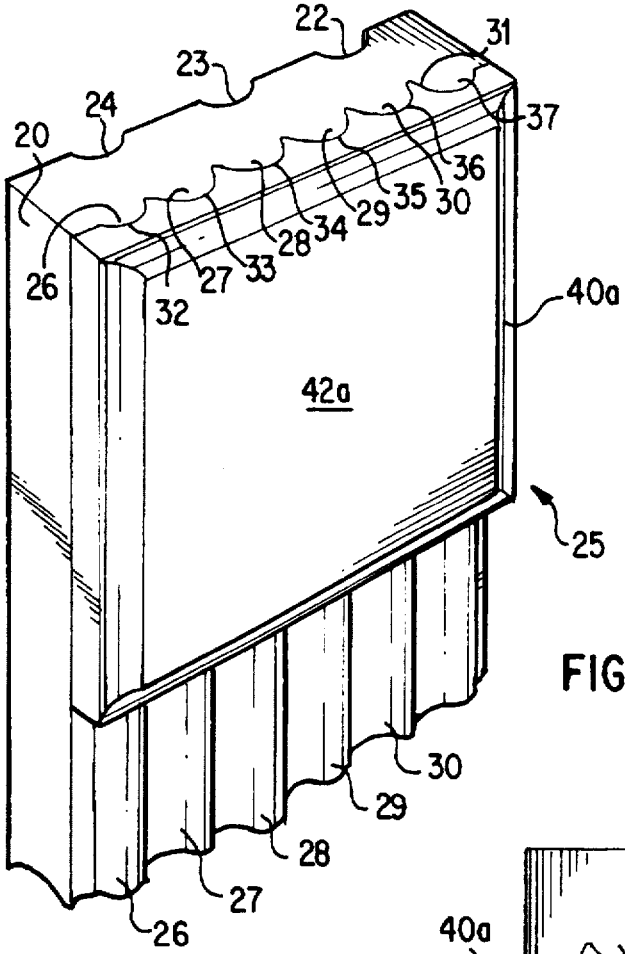
FIGS. 4–6 are respective perspective front, top and side views of the same embodiment of the invention as shown in FIGS. 1–3, but with the molding strip reversed, i.e. the beaded surface is observable and the attachment surface of the molding cap matches the beaded surface of the molding strip.
Figure 5:
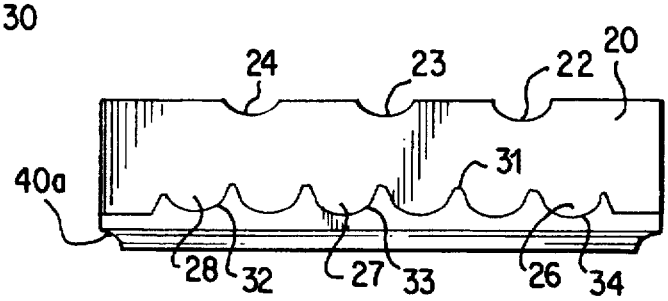
Figure 6:
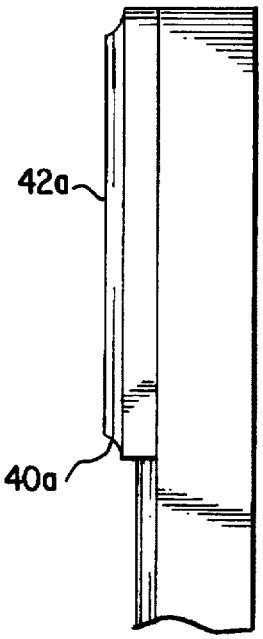
Figure 7:
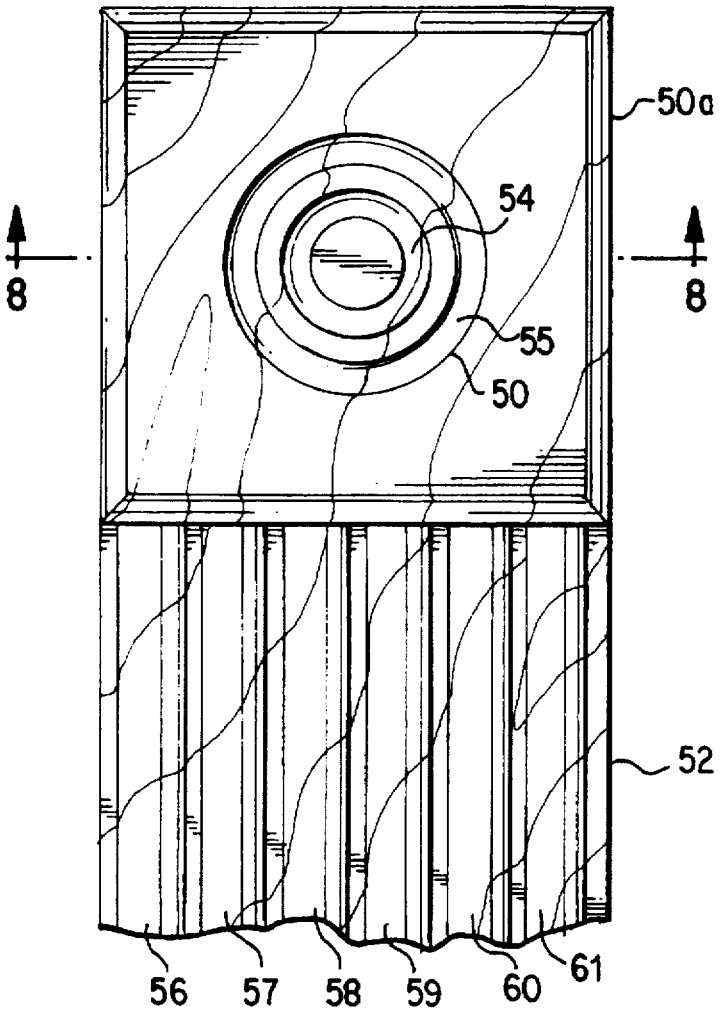
FIG. 7 shows a front view of a combined molding strip and molding cap in accordance with the invention wherein the molding cap includes a rosette-type design in the face thereof.
Figure 8:
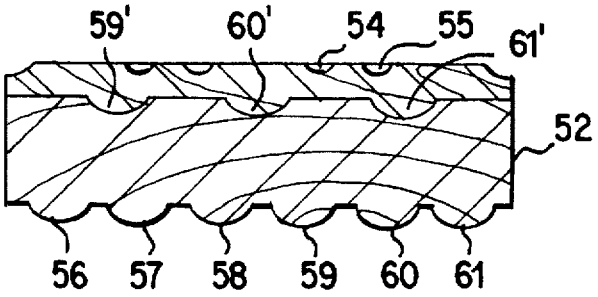
FIG. 8 shows a cross section along the lines 8—8 of FIG. 7 illustrating the clearance between the depth of the Rosette-type design and the attachment surface of the molding cap.

The molding caps of the invention may be produced with different patterns on surface **42*a* of FIG. 4 and also with a three-dimensional design such as the Rosette-type design 50 as illustrated in FIG. 7. The Rosette-type design 50 is illustrated in cross-section in FIG. 8 wherein molding cap 50*a* is shown mated with molding strip 52 and respective concentric rings 54 and 55 are shown in FIG. 8. The depth of concentric rings 54 and 55 is such so that there is no interference with the mating of beaded ridges 56, 57, 58, 59, 60 and 61 of molding cap 50*a* with fluted channels 59', 60' and 61' of molding strip 52**.

It is evident to one of ordinary skill in the carpentry art that the combined molding cap(s) and molding strip of the invention as described herein provides a stable mating of the molding cap(s) and the molding strip because of the amount of direct surface contact with one another.

Figure 9:
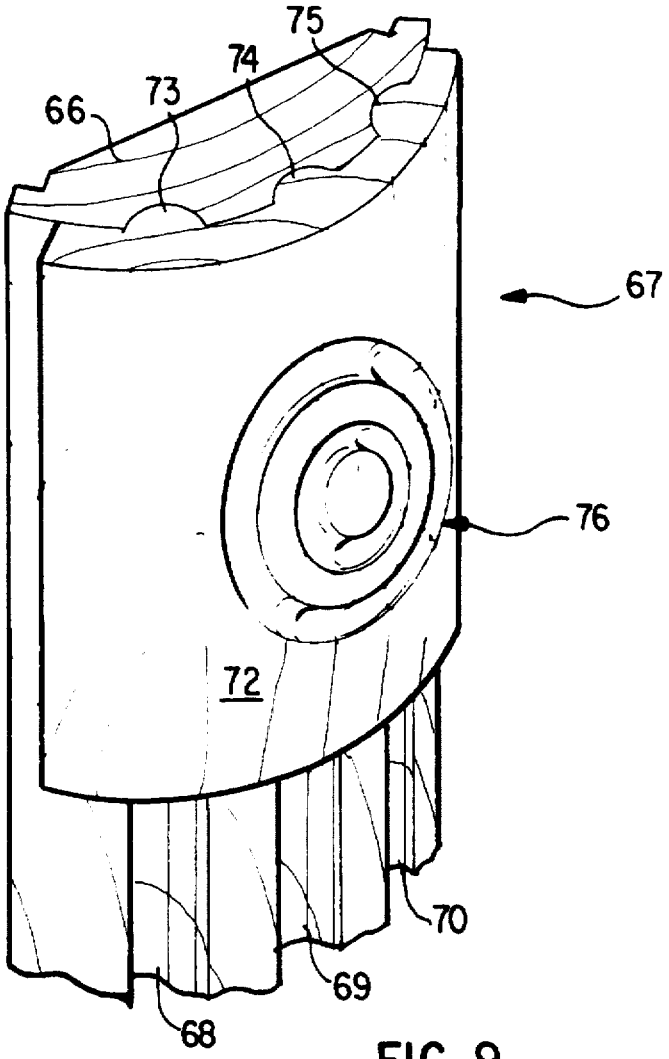
FIGS. 9–11 are respective front perspective, top and front views of another embodiment of the invention wherein the combined molding strip and molding cap are curved.
Figure 10:
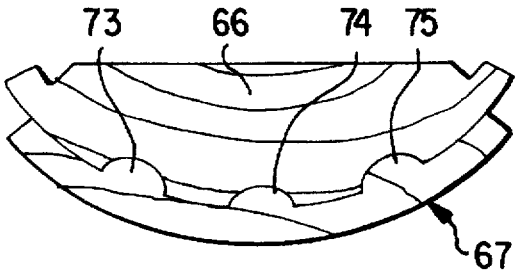
Figure 11:
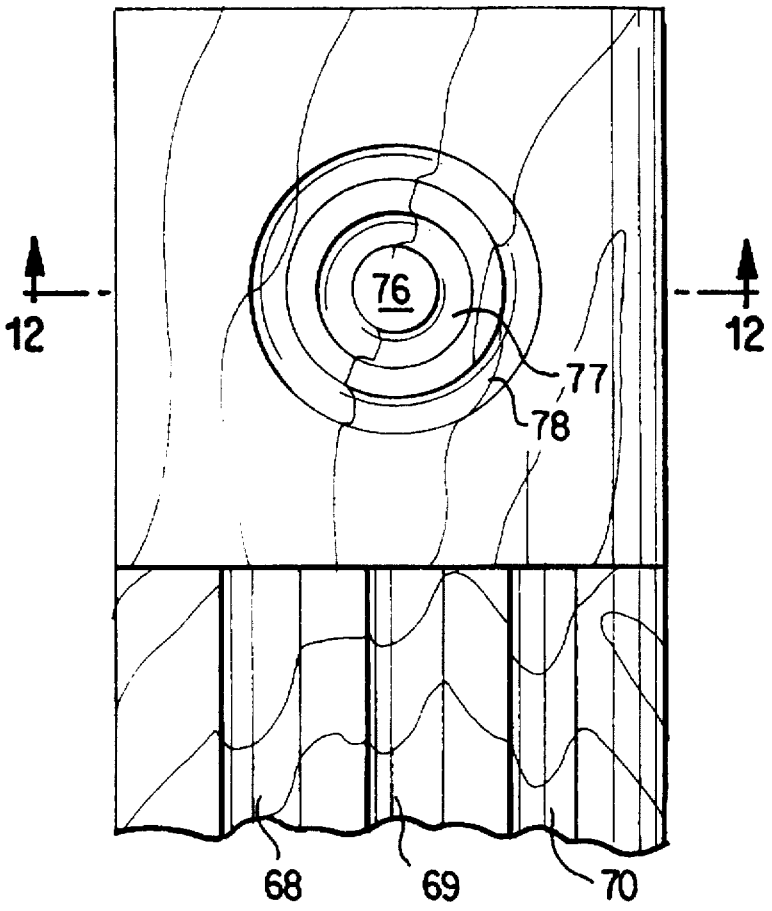
Figure 12:
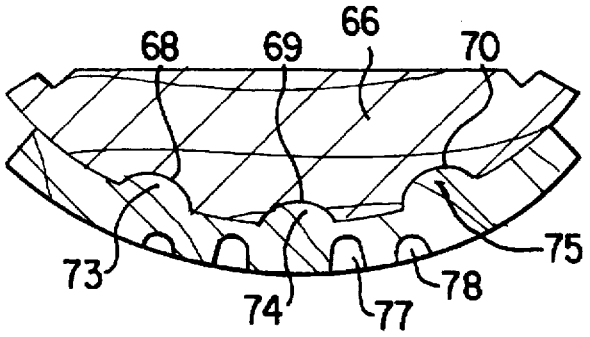
FIG. 12 is a sectional view along lines 12—12 of FIG. 11 and illustrating the clearance between the depth of the Rosette-type design and the attachment surface of the molding cap.

FIGS. 9–11 illustrate another embodiment of the invention wherein the molding strip and molding cap are curved and the opposing side of the curved molding strip is flat to provide an surface for attachment of the combined molding cap(s) and molding strip with a wall, door jam or other surface. Thus, in FIGS. 9–11, molding strip 66 has a curved surface 67 with fluted channel 68, 69, 70 and mating molding cap 72 having beaded ridges 73, 74, 75 engaging the respective fluted channels of the molding strip 66. As in the previous embodiment of FIGS. 7 and 8, a Rosette-type pattern 76 is formed in the surface of molding cap 72. In FIG. 11 a front view of the Rosette-type pattern 76 is illustrated and FIG. 12 shows a cross-section of the molding cap 72 along line 12—12 of FIG. 11. Inner ring 77 and outer ring 78 of Rosette-type pattern 76 have a depth so as not to interfere with the engagement of beaded ridges 73, 74, 75 with fluted channels 68, 69, 70.

The molding caps of the invention are attached to a molding strip by adhesives, staples or nails as such attachment means are well known to those skilled in the carpentry art.

It is evident from a consideration of the foregoing description that, although only a portion of the molding strops are shown, the molding caps may be attached to portions of the molding strip other than the portions illustrated in the various drawings. In that connection it is also evident that the molding caps, once engaged with the molding strip, may be slid along the surface thereof until the desired point of attachment is reached, thereby providing an easy way to determine the most ideal position at which to attach the molding cap to the molding strip.

The above description serves only to describe exemplary embodiments of the best mode of making the combined molding cap(s) and molding strips of the invention to demonstrate the features and advantages of its construction and operation. The invention is not intended to be limited thereby, as those skilled in the carpentry art will readily perceive modifications of the above-described embodiments. Thus the invention is intended to be limited only by the following claims and the equivalents to which the claimed components thereof are entitled.

What is claimed is:

1. A combined molding cap and molding strip, comprising:

a molding strip having opposed attachment surfaces extending along the longitudinal axis thereof;

a plurality of beaded ridges extending along one attachment surface of the molding strip and a plurality of fluted channels extending along the opposed attachment surface of the molding strip; and at least one molding cap having a surface including at least one of complementary fluted channels and beaded ridges for respectively engaging the beaded ridges and fluted channels of the molding strip so that said at least one molding cap is in closely abutting relationship with said molding strip at a desired location along said longitudinal axis.

2. A combined molding cap and molding strip according to claim 1, wherein the at least one molding cap is attached to the molding strip by adhesive.

3. A combined molding cap and molding strip according to claim 1, wherein the at least one molding cap and the molding strip are attached by nails or staples.

4. A combined molding cap and molding strip according to claim 1, wherein the surface of the at least one molding cap opposite the surface having at least one of complementary fluted channels and beaded ridges includes a Rosette-type pattern.

5. A combined molding cap and molding strip, comprising:

a molding strip having a flat mounting surface and an opposed curved surface including at least one of fluted channels and beaded ridges, said mounting surface and said opposed curved surface extending along a longitudinal axis of said molding strip;

at least one molding cap having a curved surface complementary to said opposed curved surface with at least one of complementary fluted channels and beaded ridges for engaging the beaded ridges or fluted channels of the molding strip so that said at least one molding cap is in closely abutting relationship with said molding strip at a desired location along said longitudinal axis.

6. A combined molding cap and molding strip according to claim 5, wherein the curved surfaces of the molding strip and the at least one molding cap have a curvature of 45 degrees.

7. A combined molding cap and molding strip according to claim 5, wherein the curved surfaces of the molding strip and the at least one molding cap have a curvature of 90 degrees.

8. A combined molding cap and molding strip according to claim 5, wherein the at least one molding cap is attached to the molding strip by adhesive.

9. A combined molding cap and molding strip according to claim 5, wherein the at least one molding cap and the molding strip are attached by nails or staples.

10. A combined molding cap and molding strip according to claim 5, wherein the surface of the at least one molding cap opposite the surface having at least one of complementary fluted channels and beaded ridges includes a Rosette-type pattern.

11. A molding cap, comprising:

at least one molding cap having an attachment surface including at least one of complementary fluted channels and beaded ridges for respectively engaging complementary beaded ridges and fluted channels of a molding strip having a longitudinal axis so that said at least one molding cap is in closely abutting relationship with said molding strip at a desired location along the longitudinal axis; and an exposed surface opposing said attachment surface and including a Rosette-type pattern.

* * * * *